US008468633B2

(12) United States Patent
Arnold

(10) Patent No.: US 8,468,633 B2
(45) Date of Patent: Jun. 25, 2013

(54) FLOOR-CLEANING EQUIPMENT

(75) Inventor: Peter Arnold, Heppenheim (DE)

(73) Assignee: Carl Freudenberg, Weinheim (DE)

( * ) Notice: Subject to any disclaimer, the term of this patent is extended or adjusted under 35 U.S.C. 154(b) by 407 days.

(21) Appl. No.: 12/744,243

(22) PCT Filed: Aug. 5, 2008

(86) PCT No.: PCT/EP2008/006418

§ 371 (c)(1),
(2), (4) Date: May 21, 2010

(87) PCT Pub. No.: WO2009/065450

PCT Pub. Date: May 28, 2009

(65) Prior Publication Data

US 2010/0251497 A1 Oct. 7, 2010

(30) Foreign Application Priority Data

Nov. 23, 2007 (DE) ..... 10 2007 056 843

(51) Int. Cl.
*A47L 11/24* (2006.01)

(52) U.S. Cl.
USPC ..... 15/4; 15/41.1; 15/52.1; 15/98

(58) Field of Classification Search
USPC ..... 15/4, 41.1, 52.1, 98
See application file for complete search history.

(56) References Cited

U.S. PATENT DOCUMENTS

| | | | | |
|---|---|---|---|---|
| 184,633 | A * | 11/1876 | Leach | 15/41.1 |
| 5,392,491 | A | 2/1995 | Hwang et al. | |
| 6,845,538 | B2 * | 1/2005 | Nakamura | 15/41.1 |
| 7,013,528 | B2 | 3/2006 | Parker et al. | |
| 8,020,236 | B2 * | 9/2011 | Kaleta et al. | 15/4 |
| 8,087,117 | B2 * | 1/2012 | Kapoor et al. | 15/52.1 |
| 2004/0168281 | A1 | 9/2004 | Sako et al. | |

FOREIGN PATENT DOCUMENTS

| | | | |
|---|---|---|---|
| CN | 1248422 | A | 3/2000 |
| CN | 1660006 | A | 8/2005 |
| DE | 102004009908 | A1 | 9/2005 |
| GB | 1442587 | A | 7/1976 |
| GB | 2260892 | A | 5/1993 |
| GB | 2389035 | A | 12/2003 |
| JP | 2003-135348 | * | 5/2003 |

OTHER PUBLICATIONS

International Search Report for PCT/EP2008/006418 mailed on Mar. 12, 2009.

* cited by examiner

*Primary Examiner* — Mark Spisich
(74) *Attorney, Agent, or Firm* — Leydig, Voit & Mayer, Ltd.

(57) ABSTRACT

A cleaning device includes a base body, a rotatable brush roller disposed on the base body, a dirt container disposed on the base body, a cloth holder attached removably to the base body, and a cleaning cloth attachable to the cloth holder.

11 Claims, 5 Drawing Sheets

FLOOR-CLEANING EQUIPMENT

CROSS REFERENCE TO PRIOR APPLICATIONS

This application is a U.S. National Phase Application under 35 U.S.C. §371 of International Application No. PCT/EP2008/006418, filed on Aug. 5, 2008 and claims benefit to German Application No. DE 10 2007 056 843.8, filed on Nov. 23, 2007. The International Application was published in German on May 28, 2009 as WO 2009/065450 under PCT Article 21 (2).

The invention relates to a cleaning device, comprising a base body on which a rotatable brush roller and a dirt container are arranged and a cloth holder to which a cleaning cloth can be attached.

BACKGROUND

A cleaning device of this type is known from U.S. Pat. No. 7,013,528 B2. The previously known cleaning device consists of a base body to which a rotatable brush roller driven by an electric motor is attached, said roller transporting the dirt which is picked up into a dirt container arranged behind the brush roller. The brush roller picks up coarse dirt, which is picked up and retained by the dirt container. Fine dirt, in particular dust, can pass through the brush roller and is picked up by the cleaning cloth, which is arranged behind said roller and is attached to a cloth holder. This improves the cleaning effect compared to a cleaning device comprising merely a brush roller. However, the cloth holder is foldable and is rigidly connected to the base body, in such a way that the cloth holder engages with the floor to be cleaned even when said floor is rather obstructive, as is the case when cleaning carpeted floors for example. In this case, the cloth holder makes the cleaning operation more difficult because of the high friction.

SUMMARY OF THE INVENTION

An aspect of the invention is to develop the cleaning device further in such a way that the cleaning performance is improved, in particular when cleaning carpeted floors.

In an embodiment, the cloth holder is attached removably to the base body. Attached removably means that the cloth holder, equipped with a cleaning cloth, can be selectively attached to or removed from the cleaning device, and the cloth holder can be removed and reattached to the base body without undue force or effort. The cleaning device can thus be operated both with and without the cloth holder. With the cloth holder and the cleaning cloth attached thereto, the cleaning device is particularly suitable for cleaning smooth floors, such as tiles or parquet. Without the cloth holder, the cleaning device is particularly suitable for cleaning rough and soft floors, such as carpeted floors. When cleaning rough floors, it is particularly advantageous that the friction of the cleaning device is low, because of the absence of the cloth holder, and ergonomic cleaning operation is thus possible. On the side facing the floor to be cleaned, the cloth holder advantageously comprises a resilient covering which allows optimal pressing of the cleaning cloth against the floor to be cleaned. The covering can be formed from open-cell or closed-cell foam. The cleaning cloth is attached by means of soft clips, which are located on the side of the cloth holder facing away from the floor to be cleaned. The soft clips consist of a disc-shaped elastomeric material in which a star-shaped opening is formed. The side of the cloth holder facing away from the floor to be cleaned is covered by the base body when the cloth holder is attached to the base body.

The cloth holder may be attachable to the base body by a snap-in locking means. In this case, the snap-in locking means is formed so that it can be operated in a simple manner and preferably by the operator's foot, in such a way that the cloth holder can be removed from the base body without an additional handle. The snap-in locking means makes it possible for the cloth holder to be released from and attached to the base body without being damaged.

The snap-in locking means may comprise adjustable snap-in locking tabs for attaching the cloth holder to the base body. The snap-in locking tabs engage in recesses which are formed in the base body. The snap-in locking tabs are adjustable in such a way that in order to remove the cloth holder, they can be retracted in the snap-in locking means in such a way that the cloth holder is released.

The snap-in locking means may comprise an actuation button, which is arranged in a recess of the base body. The actuation button is spring-loaded, and when actuated causes the snap-in locking tabs to retract in the snap-in locking means and thus causes the cloth holder to be released. The actuation button is formed in such a way that it can be operated by foot. The recess is preferably arranged on the rear face, on the side remote from the brush roller, and is formed as a cutout. To remove the cloth holder, the actuation button is actuated by foot and the foot continues to rest on the actuation button, and subsequently the cleaning device is removed by pulling the handle attached to the base body. No further interventions are required either for removing or for attaching the cloth holder. If the actuation button projects beyond the base body at least in part on the side remote from the cloth holder, then it is particularly easy to reach and particularly simple to operate.

The base body may comprise rollers, which project into openings formed in the cloth holder. This means that the cleaning device is easy to manoeuvre even without the cloth holder. The rollers may extend sufficiently far into the cloth holder to terminate in line with the side facing the floor to be cleaned. In this way, the position of the cleaning device on the floor to be cleaned when the cloth holder is removed is identical to the position of the cleaning device when the cloth holder is attached.

The dirt container may be removable. For this purpose, the dirt container may be introduced into the base body in the manner of a drawer or be lockable in the base body from the upper side, the side remote from the floor to be cleaned. In this case, it is particularly easy to remove the dirt container from the cleaning device. For emptying the dirt container, the base of the dirt container may be formed so as to be foldable. In this case, the base is preferably joined to the dirt container housing by a film hinge and is sealed in a dust-tight manner by a snap-in locking device. When the snap-in locking means is released, the base opens automatically and reveals a very large opening, through which the dirt can be removed particularly easily from the dirt container. The snap-in locking means simultaneously acts as a locking means for fastening the dirt container in the base body. To improve the tightness, the base has an elevation on the edge thereof, which elevation engages in a congruently shaped recess of the housing when the base is sealed. The base of the dirt container further comprises ribs in such a way that the base does not deform and always remains tight.

The dirt container may comprise a cap, which projects beyond the brush roller at least in part. In this case, the cap may be articulated or integrally connected to the base body. In this case, when the cap is removed the dirt container is always also removed upwards from the base body. Because the cap projects beyond the brush roller, said roller is released at least in part, after the removal of the cap, and this is particularly advantageous if said roller is to be cleaned.

The brush rollers may be displaceable and removable in the axial direction in a spring-loaded manner. On both end faces, the brush roller comprises recesses in which pins, arranged on the base body, engage for mounting. For removal, the brush roller is moved axially against the spring. If the pin on one end face is exposed, the brush roller can be tilted out. If the cap encompasses the brush roller, the brush roller can be removed upwards after the cap is removed. This means that the brush roller can also be removed for cleaning or replacement when the cleaning device is upright on the floor, leading to easier maintenance.

The brush roller may comprise a disc-shaped projection. The projection is preferably arranged in the region of the end face opposite the spring-loaded end face. The projection acts as a handle member and facilitates the removal of the brush roller. The radial extension of the projection in this case is less than or equal to the radial extension of the bristles of the brush roller.

The configuration of the dirt container and the brush roller as described in the previous four paragraphs may also be produced in its own right, independently of a cloth holder, on a cleaning device.

BRIEF DESCRIPTION OF THE DRAWINGS

In the following, embodiments of the cleaning device according to the invention are described in greater detail with reference to the figures, in which, in each case schematically.

DETAILED DESCRIPTION

Figure 1:
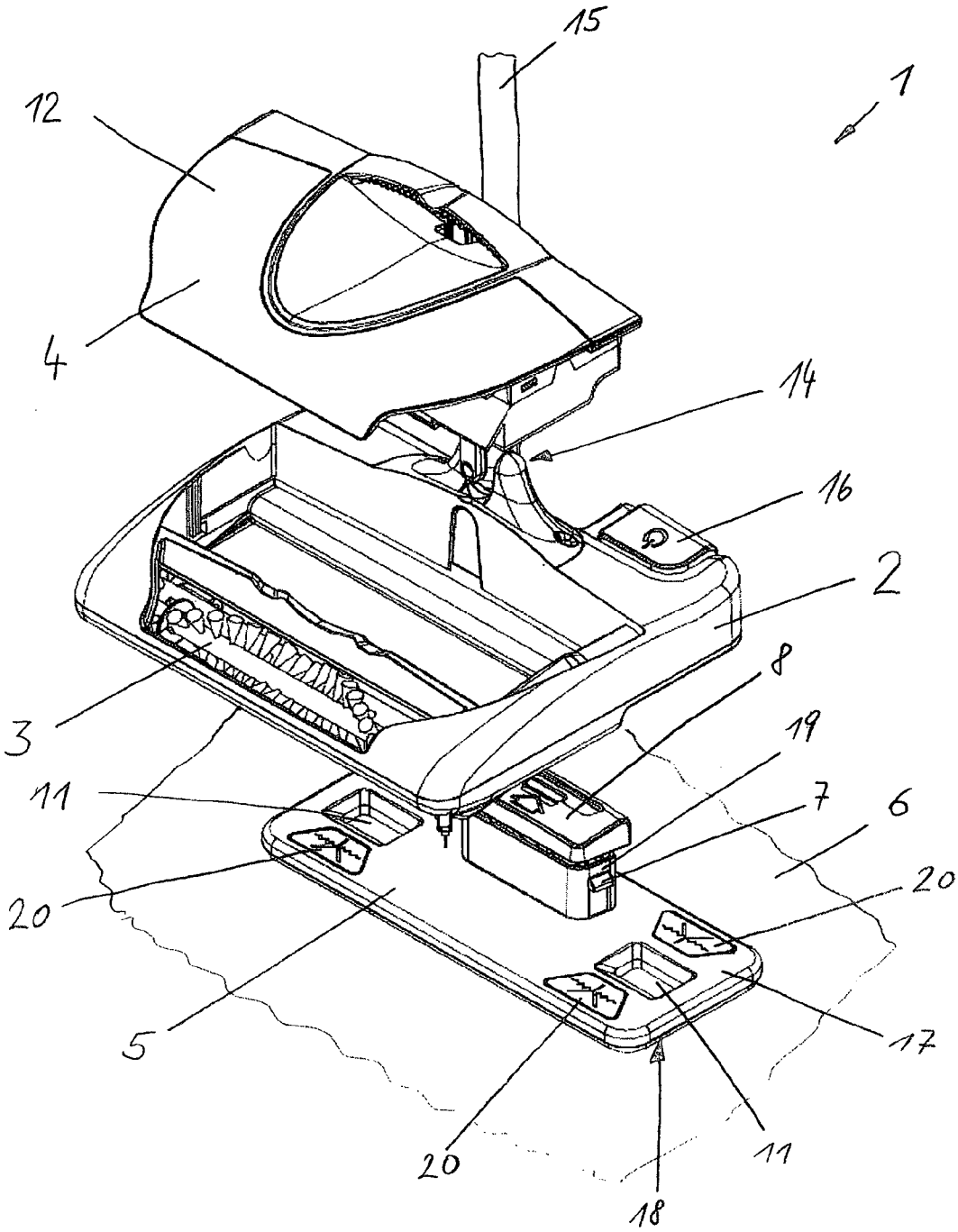
FIG. 1 is an exploded view of the cleaning device.

FIG. 1 shows a cleaning device 1, consisting of a base body 2 to which a handle 15 is connected via an articulation 14. The articulation 14 comprises a catch in such a way that the handle 15 can be locked folded up vertically by the base body 2 and cannot fall over. Furthermore, for mounting the handle 15 can be locked in a further position, specifically parallel to the base body 2, by means of the catch. In this way, the cleaning device 1 can be stored against or hung up on a wall in a space-saving manner. A rotatable brush roller 3 and a dirt container 4 are arranged in the base body 2. For this purpose, the base body 2 is opened in the direction of the floor to be cleaned, in such a way that the brush roller 3 engages with the floor to be cleaned. The brush roller 3 is driven via an electric motor, which is powered by rechargeable batteries, specifically lithium ion batteries. For switching the electric motor on and off, a switch 16 is located on the upper face of the base body 2 and is configured in such a way as to be operable by foot. The battery is charged by means of an external charging device. A socket is provided for this purpose and is arranged internally, behind an aperture in the base body 2. In this case, the socket is offset sufficiently far inwards that only the charging device adapted for the batteries and the electronic circuitry can be inserted. The cleaning device 1 is further equipped with a load protector, which automatically switches of the cleaning device 1 if an overload occurs, as is the case for example when relatively large objects become caught in the brush roller 3. The brush roller 3 is connected to the dirt container 4, which is also arranged in the base body 2. The dirt container 4 is formed in a box shape and can be removed upwards from the base body 2. The dirt container 4 comprises a cap 12 as an upper end, the cap 12 being configured in such a way as to project in part beyond the brush roller 3 when the dirt container 4 is located in the base body 2. The base of the dirt container 4 is attached to the dirt container 4 via a film hinge and is fastened by a snap. The snap can be released by a lever in such a way that the base folds down and the dirt container can thus be emptied. The cap 12 is configured to be transparent so that it is possible to check the level of dirt in the dirt container without having to open it. A cloth holder 5, to which a cleaning cloth 6 can be attached, is further arranged on the cleaning device 1. The cloth holder 5 consists of a base plate 17 having a cleaning side 18 and a snap-in locking means 19 which is arranged on the cloth holder 5 on the side remote from the cleaning side 18. The cloth holder 5 is attached removably to the base body 2 by the snap-in locking means 19. For this purpose, the snap-in locking means 19 comprises adjustable snap-in locking tabs 7 which can be brought into engagement with recesses located in the base body 2. The snap-in locking tabs 7 are adjusted via an actuation button 8, which projects beyond the base body 2 on the side remote from the cloth holder. The cleaning side 18 consists of a resilient foam-like material. On the other side there are soft clips 20 for attaching the cleaning cloth 6. In the base plate 17 there are openings 11 into which rollers 10 project which are rotatably attached to the base body 2.

Figure 2:
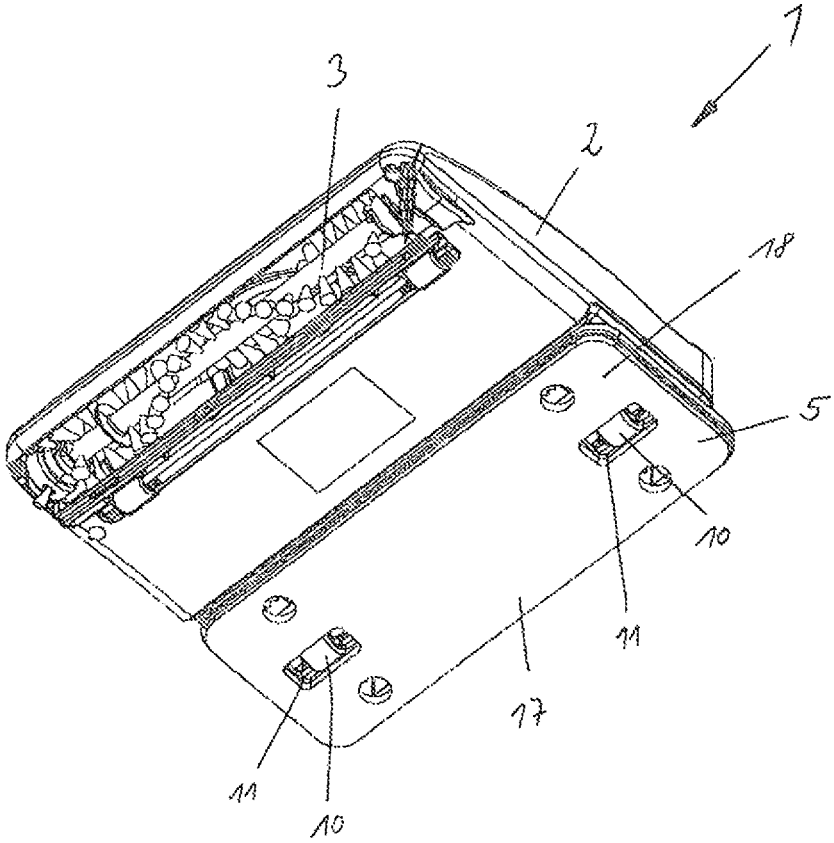
FIG. 2 is a view of the cleaning device with attached cloth holder from below.

FIG. 2 is a view from below of the cleaning device 1 illustrated in FIG. 1. This shows that the rollers 10 arranged on the base body 2 project through the openings 11 provided in the base plate 17 of the cloth holder 5 and thus come into contact with the floor to be cleaned when there is no cleaning cloth 6 on the cloth holder 5. This is particularly advantageous for cleaning operations on soft floorings such as carpets. In particular, the rollers 10 also make it possible to use the cleaning device 1 entirely without the cloth holder 5.

Figure 3:
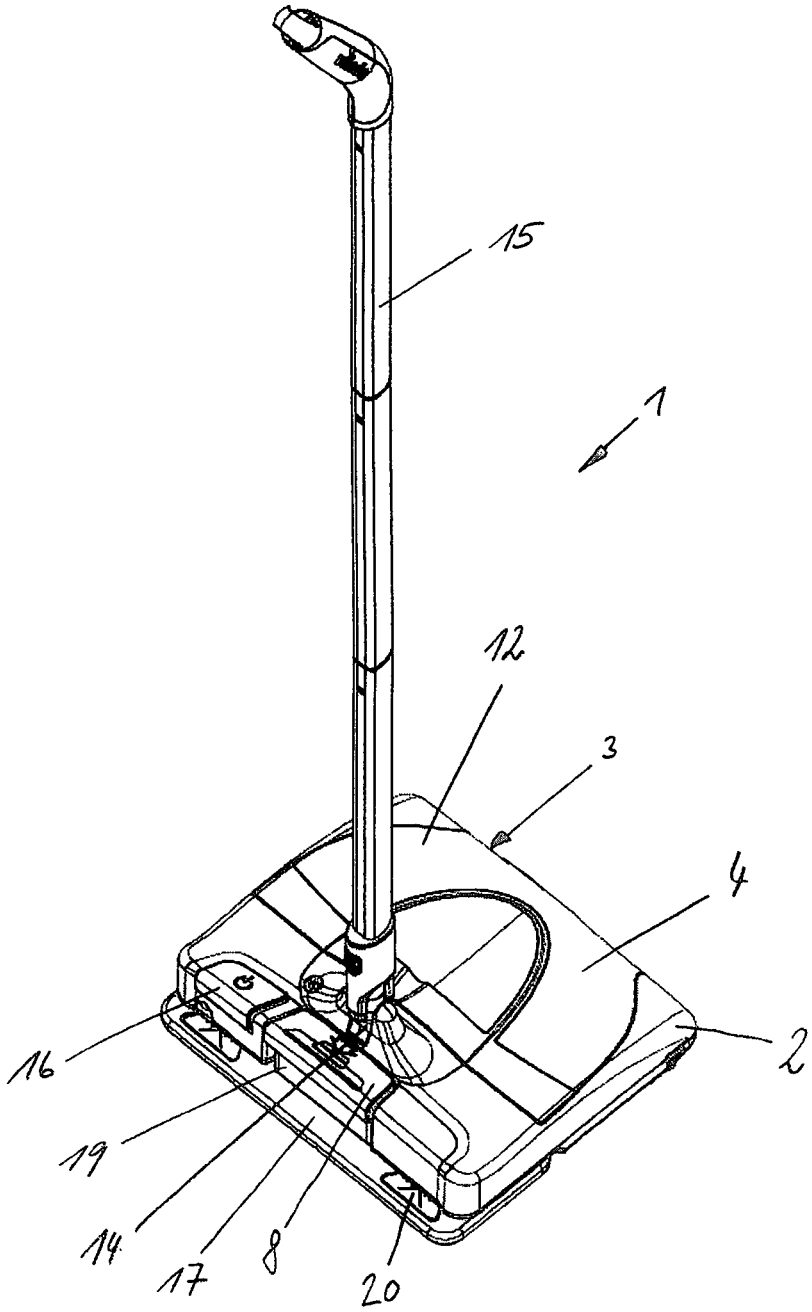
FIG. 3 shows the cleaning device with attached dirt container.

FIG. 3 shows a cleaning device 1, consisting of a base body 2 to which a handle 15 is attached via an articulation 14. A rotatable brush roller 3 and a dirt container 4 are arranged in the base body 2. For this purpose, the base body 2 is opened in the direction towards the floor to be cleaned, in such a way that the brush roller 3 engages with the floor to be cleaned. The brush roller 3 is connected to the dirt container 4, which is also arranged in the base body 2. The dirt container 4 is formed in a box shape and can be removed upwards from the base body 2. The dirt container 4 comprises a cap 12 as an upper end, the cap 12 being configured in such a way as to project in part beyond the brush roller 3 when the dirt container 4 is located in the base body 2. The base 21 of the dirt container 4 is attached to the dirt container 4 via a film hinge 22 and is fastened by a snap-in locking means 23. The snap-in locking means 23 can be released by a lever in such a way that the base 21 folds down and the dirt container 4 can thus be emptied. The snap-in locking means 23 simultaneously acts as a locking means for fixing the dirt container 4 in the base body 2. To improve the tightness, the base 21 has an elevation on the edge thereof, which elevation engages in a congruently shaped recess of the housing when the base is sealed. The base of the dirt container further comprises ribs in such a way that the base does not deform and always remains tight. The cap 12 is configured to be transparent in such a way that it is possible to check the level of dirt in the dirt container 4 without having to open it.

Figure 4:
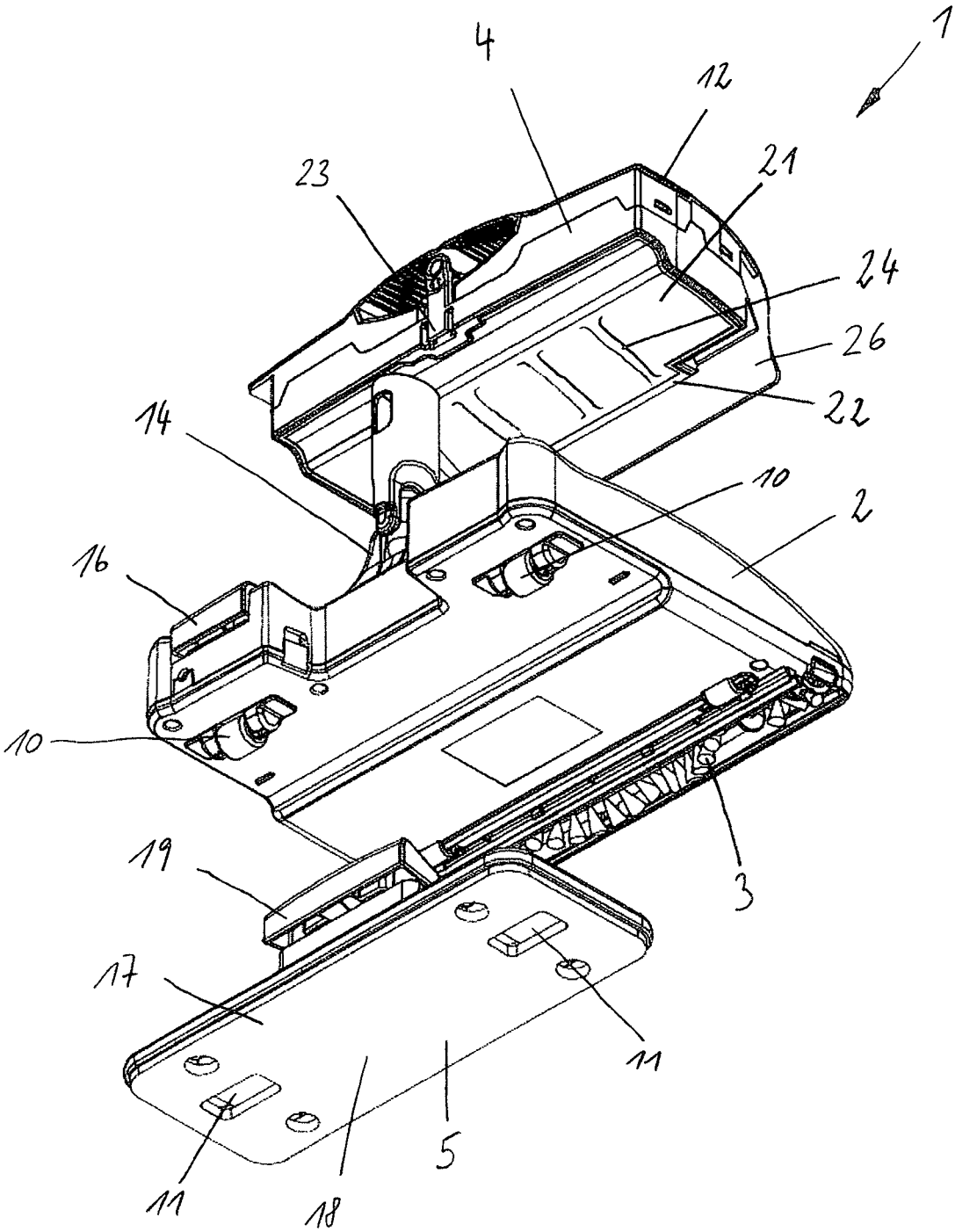
FIG. 4 shows the cleaning device of FIG. 3.

FIG. 4 shows the cleaning device of FIG. 3. It can be seen that the base 21 comprises a plurality of ribs 24 which reinforce said base 21. It can further be seen that the cap 12 comprises an extension 26 which encompasses the brush roller 3. This means that the brush roller 3 is covered when the dirt container 4 is mounted and easily accessible when the dirt container 4 is not mounted.

Figure 5:
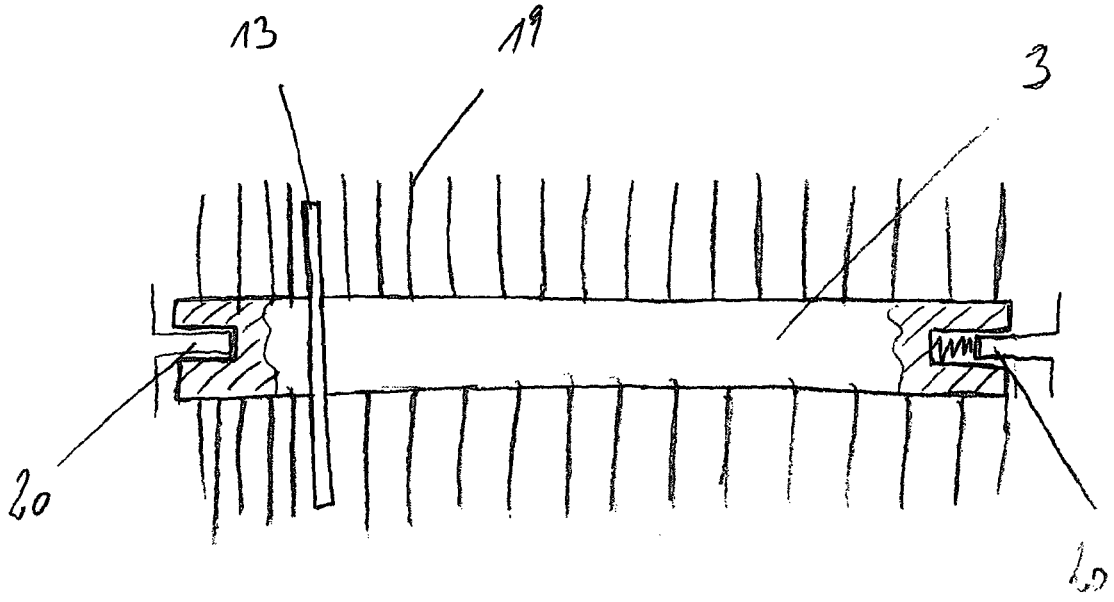
FIG. 5 shows a brush roller for one of the above cleaning devices.

FIG. 5 shows a brush roller 3 for one of the cleaning devices 1 disclosed above. The brush roller 3 comprises a rotationally symmetric core on which flexible bristles 19 distributed about the circumference are arranged. A disc-shaped projection 13 acting as a handle is further arranged on the core. Guides 20, via which the brush roller 3 can be mounted in the base body, are attached to both end faces. In this case, one guide is spring-loaded in such a way that the brush roller 3 can be displaced and removed in the axial direction in a spring-loaded manner. In other configurations, it is also conceivable for the mounting in the base body 2 to be formed flexibly in such a way that the brush roller 3 can be removed after folding away the mounting.

The invention claimed is:

1. A cleaning device comprising:

a base body;

a rotatable brush roller disposed on the base body;

a dirt container disposed on the base body;

a cloth holder attached removably to the base body; and a cleaning cloth attachable to the cloth holder, wherein the cloth holder includes a plurality of openings and the base body includes a plurality of rollers each projecting into one of the plurality of openings.

2. The cleaning device as recited in claim 1, further comprising a snap-in locking device configured to removably attach the cloth holder to the base body.

3. The cleaning device as recited in claim 2, wherein the snap-in locking device includes at least one adjustable snap-in locking tab configured to removably attach the cloth holder to the base body.

4. The cleaning device as recited in claim 2, wherein the snap-in locking device includes an actuation button disposed in a recess of the base body.

5. The cleaning device as recited in claim 4, wherein a part of the actuation button projects beyond the base body on a side remote from the cloth holder.

6. The cleaning device as recited in claim 1, wherein the dirt container is removable.

7. The cleaning device as recited in claim 1, wherein the dirt container includes a cap, at least part of the cap projecting beyond the brush roller.

8. The cleaning device as recited in claim 1, wherein the brush roller is displaceable and removable in an axial direction of the brush roller in a spring-loaded manner.

9. The cleaning device as recited in claim 1, wherein the brush roller includes a disc-shaped projection.

10. A cleaning device comprising:

a base body;

a rotatable brush roller disposed on the base body;

a dirt container disposed on the base body;

a cloth holder attached removably to the base body;

a cleaning cloth attachable to the cloth holder; and a snap-in locking device configured to removably attach the cloth holder to the base body, wherein the snap-in locking device includes an actuation button disposed in a recess of the base body.

11. The cleaning device as recited in claim 10, wherein a part of the actuation button projects beyond the base body on a side remote from the cloth holder.

* * * * *